US012312192B2

(12) United States Patent
Konno et al.

(10) Patent No.: US 12,312,192 B2
(45) Date of Patent: May 27, 2025

(54) SHEET FEEDING DEVICE AND IMAGE FORMING SYSTEM INCORPORATING THE SHEET FEEDING DEVICE

(71) Applicants: Kazunori Konno, Kanagawa (JP); Masanobu Yoshida, Kanagawa (JP); Hidetoshi Kojima, Kanagawa (JP); Tomoyuki Okada, Kanagawa (JP); Tatsuya Sugawara, Kanagawa (JP); Yusuke Hirono, Kanagawa (JP)

(72) Inventors: Kazunori Konno, Kanagawa (JP); Masanobu Yoshida, Kanagawa (JP); Hidetoshi Kojima, Kanagawa (JP); Tomoyuki Okada, Kanagawa (JP); Tatsuya Sugawara, Kanagawa (JP); Yusuke Hirono, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 96 days.

(21) Appl. No.: 18/006,946

(22) PCT Filed: Sep. 28, 2021

(86) PCT No.: PCT/IB2021/058817
§ 371 (c)(1),
(2) Date: Jan. 26, 2023

(87) PCT Pub. No.: WO2022/079531
PCT Pub. Date: Apr. 21, 2022

(65) Prior Publication Data

US 2023/0271798 A1 Aug. 31, 2023

(30) Foreign Application Priority Data

Oct. 12, 2020 (JP) ..... 2020-172110

(51) Int. Cl.
*B65H 1/14* (2006.01)

(52) U.S. Cl.
CPC ..... *B65H 1/14* (2013.01); *B65H 2405/31* (2013.01); *B65H 2801/06* (2013.01)

(58) Field of Classification Search
CPC ... B65H 1/14; B65H 2405/31; B65H 2801/06
See application file for complete search history.

(56) References Cited

U.S. PATENT DOCUMENTS 4,981,292 A 1/1991 Cosgrove
4,991,914 A * 2/1991 Kerstein ..... B07C 1/025 211/10

(Continued)

FOREIGN PATENT DOCUMENTS

JP H02-147526 A 6/1990
JP 9-30659 * 2/1997

(Continued)

OTHER PUBLICATIONS

Machine translation of JP9-30659. (Year: 1997).*

(Continued)

*Primary Examiner* — Thomas A Morrison
(74) *Attorney, Agent, or Firm* — Harness, Dickey & Pierce, P.L.C.

(57) ABSTRACT

A sheet feeding device includes a housing, a sheet stacker, a stacker elevator, an extension sheet stacker, and a support. The sheet stacker is included in the housing and is configured to stack a sheet. The stacker elevator is configured to elevate the sheet stacker. The extension sheet stacker is attached to the sheet stacker and is configured to extend outward from the housing. The support is configured to support the extension sheet stacker and has an inclined portion configured to diagonally extend in a sheet conveyance direction, to the housing from a position upstream from (Continued)

a center of the extension sheet stacker in the sheet conveyance direction, when viewed from a width direction of the sheet.

19 Claims, 11 Drawing Sheets

(56) References Cited

U.S. PATENT DOCUMENTS

| | | | | |
|---|---|---|---|---|
| 5,284,336 | A * | 2/1994 | Ricciardi | B65H 31/22 271/213 |
| 5,497,984 | A * | 3/1996 | Murakami | G03G 15/6541 270/58.27 |
| 6,189,882 | B1 * | 2/2001 | Horiuchi | B65H 39/11 271/902 |
| 6,206,365 | B1 * | 3/2001 | Nanba | B65H 33/06 271/215 |
| 10,351,366 | B2 | 7/2019 | Oshida | |
| 2005/0092885 | A1 | 5/2005 | Kuo | |
| 2013/0134659 | A1 | 5/2013 | Konno et al. | |
| 2014/0203501 | A1 | 7/2014 | Hoshino et al. | |
| 2015/0123342 | A1 | 5/2015 | Furuhashi et al. | |
| 2015/0166280 | A1 | 6/2015 | Hino et al. | |
| 2015/0353315 | A1 | 12/2015 | Suzuki et al. | |
| 2016/0016740 | A1 | 1/2016 | Niikura et al. | |
| 2016/0107853 | A1 | 4/2016 | Hashimoto et al. | |
| 2016/0107854 | A1 | 4/2016 | Hashimoto et al. | |
| 2016/0122144 | A1 | 5/2016 | Fukumoto et al. | |
| 2016/0185552 | A1 | 6/2016 | Hoshino et al. | |
| 2016/0332832 | A1 * | 11/2016 | Okura | G03G 21/1633 |
| 2017/0052504 | A1 | 2/2017 | Mori | |
| 2017/0081140 | A1 | 3/2017 | Fukumoto et al. | |
| 2019/0193433 | A1 | 6/2019 | Latsko | |

FOREIGN PATENT DOCUMENTS

| | | |
|---|---|---|
| JP | 2014-141807 | 8/2014 |
| JP | 2018-154458 | 10/2018 |

OTHER PUBLICATIONS

International Search Report issued on Dec. 13, 2021 in PCT/IB2021/058817 filed on Sep. 28, 2021.

JP Office Action for corresponding Japanese Patent Application No. 2020-172110 issued on Jul. 26, 2024.

* cited by examiner

SHEET FEEDING DEVICE AND IMAGE FORMING SYSTEM INCORPORATING THE SHEET FEEDING DEVICE

CROSS-REFERENCE TO RELATED APPLICATIONS

This application is a national phase under 35 U.S.C. § 371 of PCT International Application No. PCT/IB2021/058817 which has an International filing date of Sep. 28, 2021, which claims priority to Japanese Application No. 2020-172110, filed Oct. 12, 2020, the entire contents of each of which are hereby incorporated by reference.

TECHNICAL FIELD

Embodiments of the present disclosure generally relate to a sheet feeding device and an image forming system incorporating the sheet feeding device.

BACKGROUND ART

Various known sheet feeding devices include a housing, a sheet stacker included in the housing for stacking sheets, a stacker elevation device that elevates and lowers the sheet stacker, an extension sheet stacker that is attached to the sheet stacker, and a support that supports the extension sheet stacker.

Japanese Unexamined Patent Application Publication No. JP-2018-154458-A discloses such a known sheet feeding device in which a connection shaft that functions as a support is inserted through a through hole formed in the extension sheet stacker, so that a screw portion at the tip of the connection shaft is screwed into a screw hole formed in the side face of the sheet stacker to connect the extension sheet stacker to the sheet stacker.

SUMMARY OF INVENTION

Problems to be Solved

However, when a downward load is applied in the vertical direction to the extension sheet stacker, it is likely that the support is deformed.

Solution to Problem

According to an aspect of the present disclosure, a sheet feeding device includes a housing, a sheet stacker, a stacker elevator, an extension sheet stacker, and a support. The sheet stacker is included in the housing and is configured to stack a sheet. The stacker elevator is configured to elevate the sheet stacker. The extension sheet stacker is attached to the sheet stacker and is configured to extend outward from the housing. The support is configured to support the extension sheet stacker and has an inclined portion configured to diagonally extend in a sheet conveyance direction, to the housing from a position upstream from a center of the extension sheet stacker in the sheet conveyance direction, when viewed from a width direction of the sheet.

Advantageous Effects of Invention

According to the present disclosure, the extension sheet stacker is restrained from being bent and deformed.

BRIEF DESCRIPTION OF DRAWINGS

The accompanying drawings are intended to depict example embodiments of the present disclosure and should not be interpreted to limit the scope thereof. The accompanying drawings are not to be considered as drawn to scale unless explicitly noted. Also, identical or similar reference numerals designate identical or similar components throughout the several views.

DESCRIPTION OF EMBODIMENTS

A description is given of a sheet feeding device according to an embodiment of this disclosure.

Figure 1:
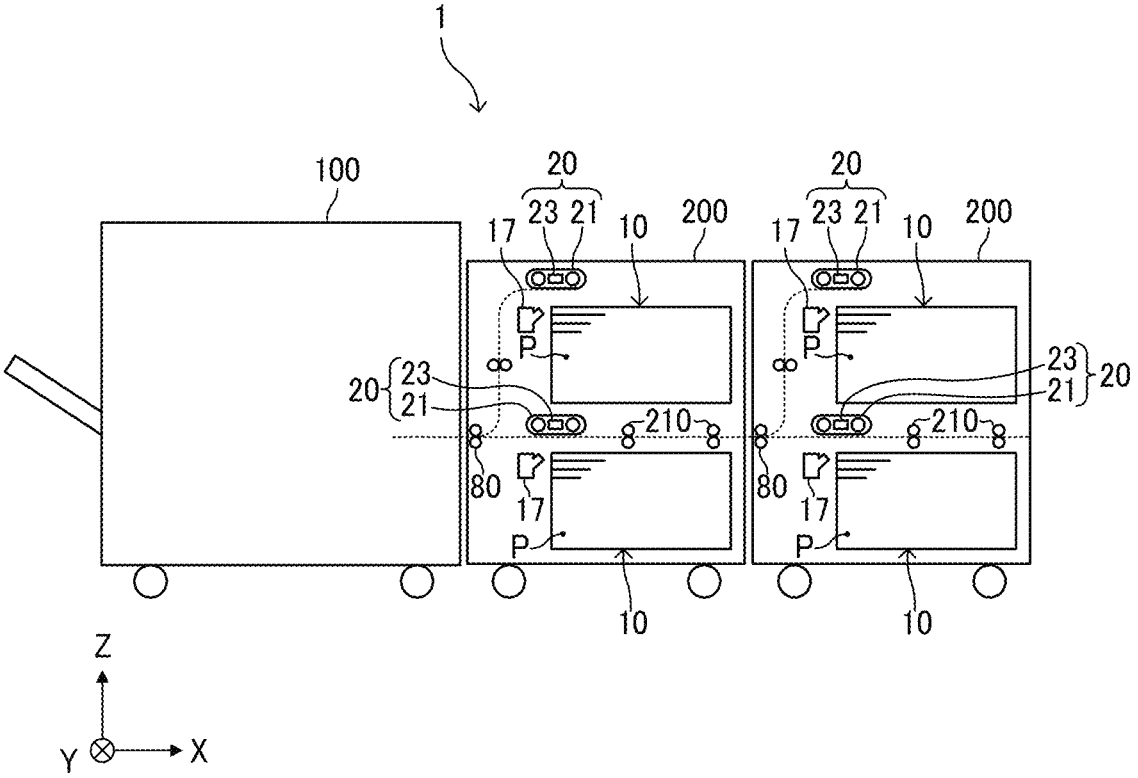
FIG. 1 is a diagram illustrating a schematic configuration of an image forming system according to an embodiment of the present embodiment.

FIG. 1 is a diagram illustrating a schematic configuration of an image forming system 1 according to an embodiment of the present disclosure.

As illustrated in FIG. 1, the image forming system 1 includes an image forming apparatus 100 and two sheet feeding devices 200. The image forming apparatus 100 forms an image on a sheet. Each of the sheet feeding devices 200 feeds a sheet to the image forming apparatus 100. One of the sheet feeding devices 200 is coupled to the side face of a housing of the image forming apparatus 100 and the other of the sheet feeding devices 200 is coupled to the side face of the one of the sheet feeding devices 200.

The sheet feeding devices 200 have the similar configuration to each other and are connectable with each other at respective positions upstream from the image forming apparatus 100 in a sheet conveyance direction. As illustrated in FIG. 1, each of the sheet feeding devices 200 includes two sheet feed trays 10 disposed vertically to each other (i.e., a lower sheet feed tray 10 and an upper sheet feed tray 10). Each of the sheet feed trays 10 is provided with a sheet feeding unit 20. The sheet feeding unit 20 includes an attraction belt 21 and a suction device 23, each separating a sheet P from the rest of the sheets P on the sheet feed tray 10 and conveying the sheet P from the sheet feed tray 10. Further, each of the sheet feed trays 10 includes an air blowing device 17 to cause the sheet P stacked on the sheet feed tray 10 to float.

Each of the two sheet feeding devices 200 includes a pair of sheet ejection rollers 80 at a downstream end of a sheet conveyance passage in the sheet feeding device 200, so as to feed the sheet P to the next process.

Each of the sheet feeding devices 200 includes pairs of upstream sheet conveyance rollers 210. Each of the pairs of upstream sheet conveyance rollers 210 conveys a sheet fed from another sheet feeding device 200 disposed at a position upstream from the sheet feeding device 200 in the sheet conveyance direction, to a gap between the attraction belt 21 and an uppermost sheet placed on top of the sheet feed tray 10.

Note that the term "sheet" includes plain paper, coated paper, label paper, OHP sheet and film, and prepreg. Prepregs are mainly used as materials for laminates and multilayer printed wiring boards. For example, the prepreg includes a sheet-like material that is manufactured by, for example, continuously impregnating a resin varnish mainly formed by a thermosetting resin such as epoxy resin and polyimide resin, into an elongated base such as glass cloth, paper, non-woven cloth, and aramid cloth, then heating, drying, and cutting. Furthermore, the "sheet" includes bag-shaped material such as an envelope and a packaging material.

The recording method of the image forming apparatus 100 to which the sheet feeding device 200 according to the present embodiment is applied is not particularly limited, and any method such as an electrophotographic method or an inkjet method may be adopted.

Figure 2:
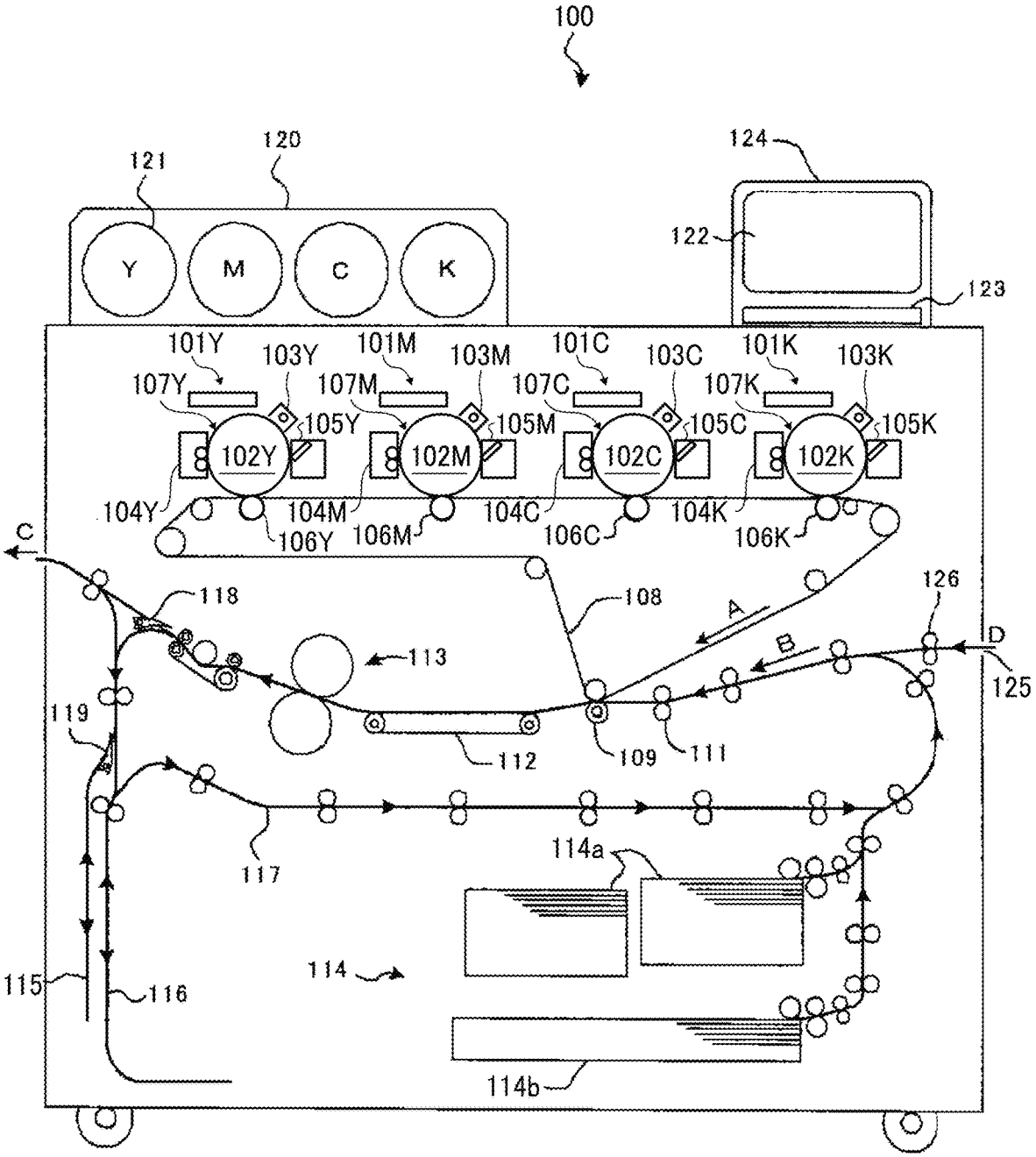
FIG. 2 is a schematic view of an image forming apparatus according to the present embodiment.

FIG. 2 is a schematic view of the image forming apparatus 100 according to the present embodiment.

The image forming apparatus 100 has printing and copying functions for forming a full color image with four color toners such as yellow (Y), magenta (M), cyan (C), and black (K). As illustrated in FIG. 2, the image forming apparatus 100 includes four image forming units 101Y, 101M, 101C, and 101K. The image forming units 101Y, 101M, 101C, and 101K, each of which forms a corresponding single color image, are aligned in an upper part of the housing of the image forming apparatus 100. The image forming units 101Y, 101M, 101C, and 101K have a substantially identical configuration and functions to each other.

Therefore, the following details of the image forming units 101Y, 101M, 101C, and 101K are described as a single image forming unit 101 that corresponds to each of the image forming units 101Y, 101M, 101C, and 101K, without the suffixes Y, M, C, and K indicating respective colors. The image forming unit 101 (i.e., the image forming units 101Y, 101M, 101C, and 101K) includes a photoconductor drum 102 (i.e., photoconductor drums 102Y, 102M, 102C, and 102K), a charger 103 (i.e., chargers 103Y, 103M, 103C, and 103K), a developing device 104 (i.e., developing devices 104Y, 104M, 104C, and 104K) and a cleaning device 105 (i.e., cleaning devices 105Y, 105M, 105C, and 105K). The charger 103, the developing device 104, and the cleaning device 105 are disposed around the photoconductor drum 102 that functions as an image bearer. Further, an optical writing device 107 is disposed at a position above the photoconductor drum 102.

An intermediate transfer belt 108 is disposed below the image forming units 101Y, 101M, 101C, and 101K. The intermediate transfer belt 108 is wound around multiple support rollers. As one of the multiple support rollers is driven and rotated by a drive unit, the intermediate transfer belt 108 is moved (rotated) in a direction indicated by arrow A in FIG. 2. A transfer roller 106 (i.e., transfer rollers 106Y, 106M, 106C, and 106K) that functions as a primary transferor is disposed facing the photoconductor drum 102 of the image forming unit 101 with the intermediate transfer belt 108 interposed between the photoconductor drum 102 and the transfer roller 106. When the transfer roller 106 and the photoconductor drum 102 contact while interposing the intermediate transfer belt 108, a primary transfer portion is formed to primarily transfer the toner image onto the photoconductor drum 102.

In the image forming unit 101, the photoconductor drum 102 is rotated in a counterclockwise direction in FIG. 2. Then, the charger 103 uniformly charges a surface of the photoconductor drum 102 to a predetermined polarity. Then, an optically modulated laser light beam is emitted from the optical writing device 107 to the charged surface of the photoconductor drum 102, so that an electrostatic latent image is formed on the charged surface of the photoconductor drum 102. The electrostatic latent image is developed with toner applied by the developing device 104 into a visible toner image. The visible toner images of respective single colors (yellow, magenta, cyan, and black) formed by the image forming units 101Y, 101M, 101C, and 101K are sequentially transferred in layers onto the surface of the intermediate transfer belt 108.

On the other hand, a sheet feeding section 114 is disposed in a lower part of the housing of the image forming apparatus 100. The sheet feeding section 114 includes sheet trays 114*a* and 114*b*. A sheet such as a transfer sheet is fed out from a selected one of the sheet feeding section 114 and the sheet feeding device 200 that is attached to the image forming apparatus 100. The fed sheet is conveyed toward a pair of registration rollers 111 in a direction indicated by arrow B in FIG. 2.

The sheet contacted against the pair of registration rollers 111 and temporarily stopped is conveyed from the pair of registration rollers 111 in synchrony with the toner image on the intermediate transfer belt 108 and delivered to a secondary transfer portion at which the secondary transfer roller 109 and the intermediate transfer belt 108 contact each other. A voltage having an opposite polarity to a toner charge polarity is applied to the secondary transfer roller 109. By so doing, the composite toner image (the full-color image) formed in layers of the respective single color images on the surface of the intermediate transfer belt 108 is transferred onto the sheet. After the toner image has been transferred onto the sheet, the sheet is conveyed by a sheet conveying belt 112 to a fixing device 113. In the fixing device 113, the toner image is fixed to the sheet by application of heat and pressure. The sheet, on which the toner image has been fixed, is ejected to an outside of the housing of the image forming apparatus 100 as indicated by arrow C in FIG. 2 and ejected onto a sheet ejection tray.

Note that, when the sheet is ejected with the back side of the sheet facing up (face-down ejection) in the single-side printing, the sheet is ejected to the outside of the housing of the image forming apparatus 100 via a sheet reverse portion 115 as indicated by arrow C in FIG. 2. By so doing, the front side and the back side of the sheet are reversed. Further, in the duplex printing, after the toner image has been fixed to one side (i.e., the front side) of the sheet, the sheet passes through a duplex reverse portion 116 to be conveyed from a reentry passage 117 to the pair of registration rollers 111 again. By so doing, a toner image formed on the surface of the intermediate transfer belt 108 is transferred onto the back of the sheet. After the toner image has been transferred onto the sheet, the toner image is fixed to the sheet in the fixing device 113. Then, similar to the single-side printing, the sheet is ejected out from the fixing device 113 in the direction C in FIG. 2 directly from the fixing device 113 or via the sheet reverse portion 115 in the direction C in FIG. 2, onto the sheet ejection tray. Further, the image forming apparatus 100 further includes switching claws 118 and 119. Each of the switching claws 118 and 119 is appropriately disposed to switch the sheet conveyance direction.

In a case of a monochrome printing, the image forming apparatus 100 according to the present embodiment uses the image forming unit 101K to form a monochrome toner image and transfers the monochrome toner image onto a sheet via the intermediate transfer belt 108. The sheet on which a monochrome toner image is handled along the same process as the sheet having a full color toner image after the toner image is fixed to the sheet.

Note that the image forming apparatus 100 further includes a toner bottle setting unit 120 on an upper face of the housing of the image forming apparatus 100. The toner bottle setting unit 120 sets respective color toner bottles 121 (i.e., toner bottles 121Y, 121M, 121C, and 121K) that contains toner to be supplied to the developing device 104 of the image forming unit 101. The image forming apparatus 100 further includes an operation unit 124 including a display 122 and a control panel 123. The operation unit 124 is also disposed on the upper face of the housing of the image forming apparatus 100. In addition, a sheet entrance D is provided on the right side of the housing of the image forming apparatus 100 in FIG. 2. A sheet conveyed from the sheet feeding device 200 (see FIG. 3) comes in the housing of the image forming apparatus 100 through the sheet entrance D. Further, a bypass tray opening 125 and a pair of bypass rollers 126 are provided in the sheet entrance D. The sheet is received through the bypass tray opening 125 and then is conveyed by the pair of bypass rollers 126.

Figure 3:
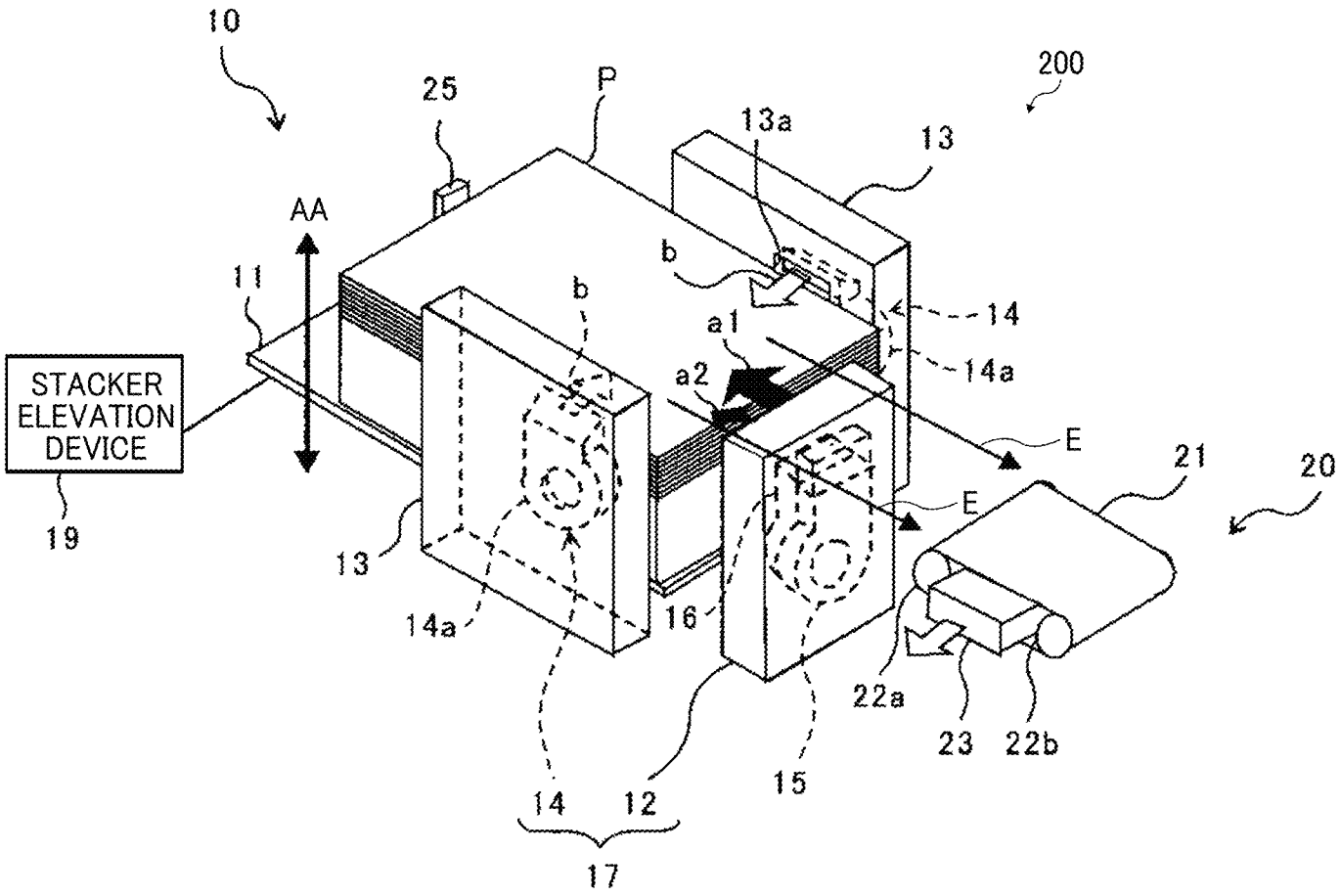
FIG. 3 is a schematic perspective view of an area including a sheet feed tray.

FIG. 3 is a schematic perspective view of an area including the sheet feed tray 10.

Note that, for understanding the present embodiment easier, the sheet feeding unit 20 in FIG. 3 is illustrated after being shifted in a direction indicated by arrow E in FIG. 3, from the original arrangement position.

Each of the sheet feed trays 10 includes a sheet stacking table 11 that functions as a sheet stacker on which a bundle of sheets P is stacked. In the present embodiment, each of the sheet feed trays 10 is capable of containing up to about 2500 sheets. The sheet feeding unit is disposed above each of the sheet trays 10. The sheet feeding unit 20 that functions as a sheet feeder attracts and feeds an uppermost sheet placed on top of the bundle of sheets P stacked on the sheet feed tray 10. The sheet feeding unit 20 includes the attraction belt 21 that functions as a conveyor and the suction device 23.

The attraction belt 21 of the sheet feeding unit 20 is stretched by two tension rollers 22*a* and 22*b* and includes multiple air drawing openings over an entire region in a circumferential direction of the attraction belt 21. The multiple air drawing openings penetrate through the attraction belt 21 from the front face to the back face. The suction device 23 is disposed inside an inner loop of the attraction belt 21. The suction device 23 is coupled with a suction fan that intakes air via an air duct that functions as an air flowing passage. As the suction device 23 generates negative pressure in the lower part of the suction device 23, the sheet P is attracted to a lower face of the attraction belt 21.

Further, each sheet feed tray 10 includes an air blowing device 17 that functions as an air blower to blow air toward the sheets P on the upper portion of the bundle of sheets P. The air blowing device 17 includes a front air blowing device 12 and side air blowing devices 14.

The side air blowing devices 14 are mounted in pairs on one side of each of a pair of side fences 13. Each of the side air blowing devices 14 blows air in a direction indicated by arrow "b" in FIG. 3, toward the side face of the upper portion of the bundle of sheets P. Each of the side air blowing devices 14 includes a side floating nozzle and a side blower 14*a*. The side floating nozzle flips and separates the sheets P of the upper portion of the bundle of sheets P and guides air to a direction to lift and float the sheets P. The side blower 14*a* sends air to the side floating nozzle. The air blown from the side floating nozzle in the direction indicated by arrow "b" in FIG. 3 is referred to as "side air". Each of the side fences 13 includes an air discharging port 13*a* that is disposed at a position facing the upper part of the bundle of sheets P. The side air is discharged from the air discharging port 13*a* of each of the side fences 13 and is blown to the side face of the upper part of the bundle of sheets P. The air blown from blowers 15 and 16 disposed in the front air blowing device 12 in directions indicated by arrows "a1" and "a2" and from the air discharging port 13*a* of each of the pair of side fences 13 in the direction indicated by arrow "b" causes the upper sheet of the bundle of sheets P to float.

Further, each sheet feed tray 10 is provided with an end fence 25 for aligning the trailing ends of the bundle of sheets P stacked on the sheet stacking table 11. The sheet stacking table 11 is movable in a direction indicated by arrow AA in FIG. 3, by a stacker elevation device 19 that functions as a stacker elevator.

Figure 4:
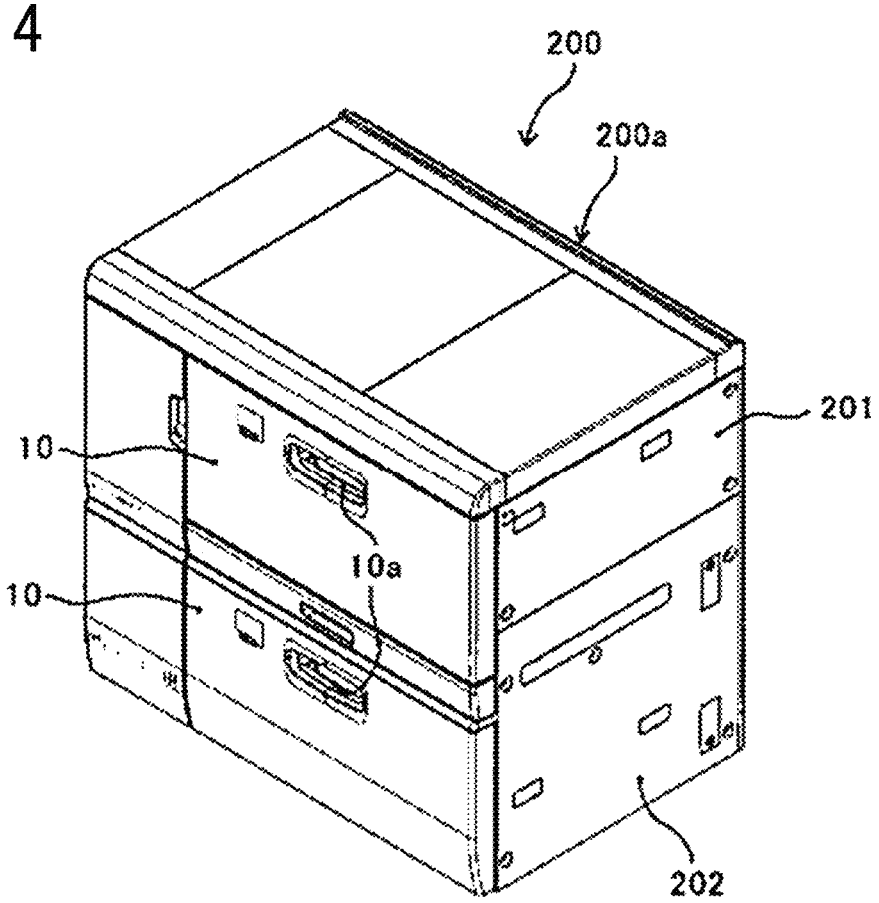
FIG. 4 is a perspective view of a sheet feeding device.

FIG. 4 is a perspective view of the sheet feeding device 200 according to an embodiment of the present disclosure.

The housing 200*a* of the sheet feeding device 200 has a box shape that is formed of, for example, a frame and panels 201 and 202 attached to the frame. Each sheet feed tray 10 is drawable toward the front side in FIG. 3, with respect to the housing 200*a* of the sheet feeding device 200. As a handle 10*a* is grabbed and pulled toward the front side by a user, the sheet feed tray is drawn out from the housing 200*a* of the sheet feeding device 200. By drawing the sheet feed tray 10 out from the housing 200*a* of the sheet feeding device 200, the sheets P are stacked into and removed from the sheet feed tray 10.

An upper panel 201 and a lower panel 202 are attached to the upstream end in the sheet conveyance direction of the housing 200*a* of the sheet feeding device 200. The upper panel 201 is detachably attached to the housing 200*a* by screws. When attaching an extension sheet stacking table to the housing 200*a*, the upper panel 201 is removed from the housing 200*a* prior to the attachment of the extension sheet stacking table. Details of the extension sheet stacking table are described below.

Figure 5:
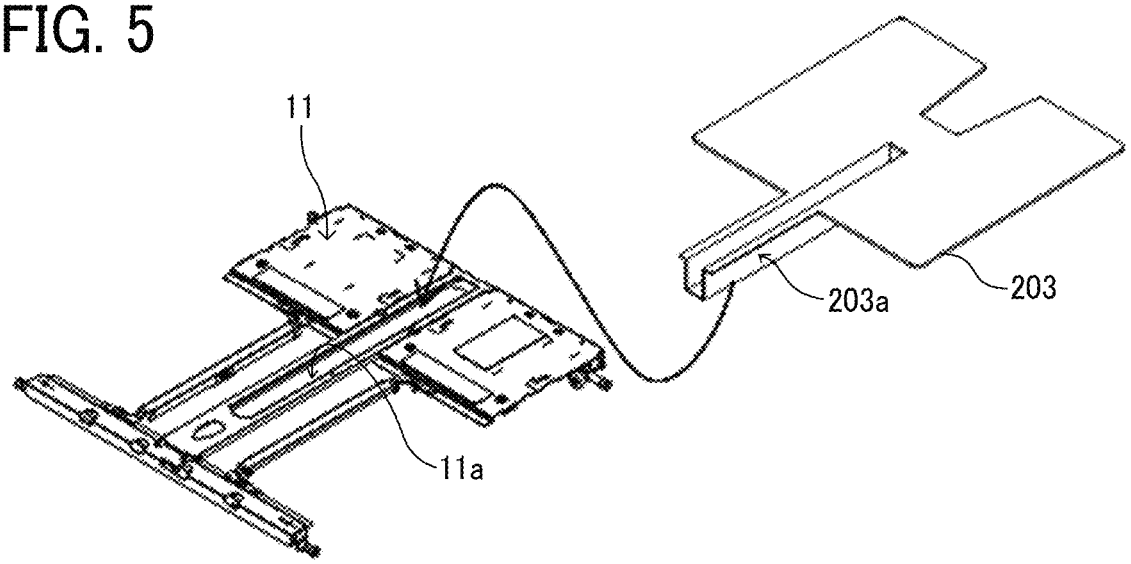
FIG. 5 is a perspective view of a sheet stacking table and an extension sheet stacking table that functions as an extension sheet stacker.

FIG. 5 is a perspective view of the sheet stacking table 11 and an extension sheet stacking table 203 that functions as an extension sheet stacker.

In the sheet feeding device 200, attaching the extension sheet stacking table 203 to the sheet stacking table 11 contributes an increase in the length of a sheet that is settable on the sheet feed tray 10, so that a long sheet is settable on the sheet feed tray 10.

An opening 11*a* is formed at the center of the sheet stacking table 11 in the width direction of the sheet P so that the end fence 25 moves in the sheet conveyance direction without interfering with the sheet stacking table 11. The extension sheet stacking table 203 has a fitting portion 203*a* to be fitted to the opening 11*a*. The fitting portion 203*a* has a concave shape.

When extending the length of a sheet that is settable on the sheet feed tray 10, the upper panel 201 and the end fence 25 are removed first. Then, the fitting portion 203*a* of the extension sheet stacking table 203 is fitted into the opening 11*a* of the sheet stacking table 11. By so doing, the extension sheet stacking table 203 is positioned on the sheet stacking table 11. Then, the extension sheet stacking table 203 is fastened to the sheet stacking table 11 by screws.

Figure 6A:
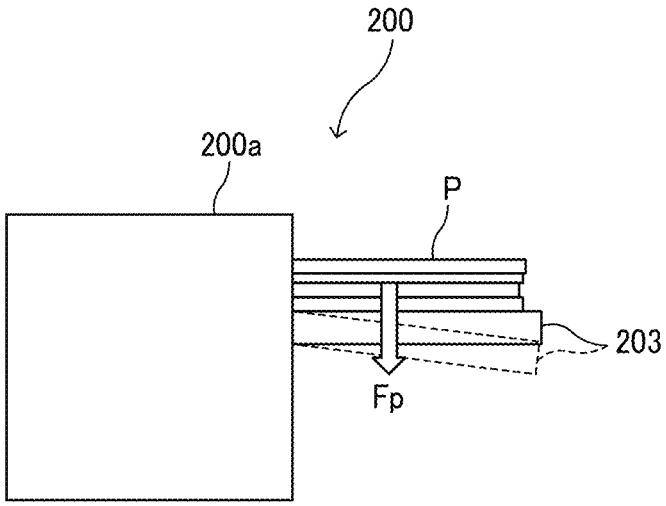
FIGS. 6A and 6B are diagrams, each illustrating an example of the sheet feeding device.
Figure 6B:
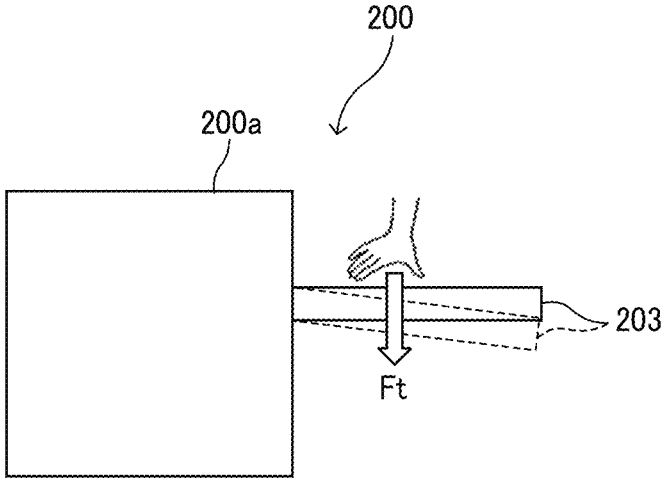

FIGS. 6A and 6B are diagrams, each illustrating an example of the sheet feeding device 200. In the sheet feeding device 200 in FIGS. 6A and 6B, the extension sheet stacking table 203 is fastened to the sheet stacking table 11 by screws. Therefore, as illustrated in FIG. 6A, the upstream end in the sheet conveyance direction of the extension sheet stacking table 203 is bent and deformed to be lowered due to the weight Fp of the bundle of sheets P stacked on the extension sheet stacking table 203. Further, as illustrated in FIG. 6B, when the sheet stacking table 11 was pressed down by a user by hand, the upstream end in the sheet conveyance direction of the extension sheet stacking table 203 was also bent and deformed to be lowered. As described above, in the sheet feeding device 200 in FIGS. 6A and 6B, as a load is applied to the extension sheet stacking table 203 in the vertically downward direction (vertically downward load Ft), it was likely that the upstream end in the sheet conveyance direction of the extension sheet stacking table 203 is bent and deformed to be lowered.

Therefore, in the present embodiment, a support member that supports the extension sheet stacking table 203 is provided so that the upstream end in the sheet conveyance direction of the extension sheet stacking table 203 is not bent and deformed to be lowered even when a vertically downward load is applied to the extension sheet stacking table 203. Next, a detailed description is given of the sheet feeding device 200 according to the present embodiment, with reference to the drawings.

Figure 7A:
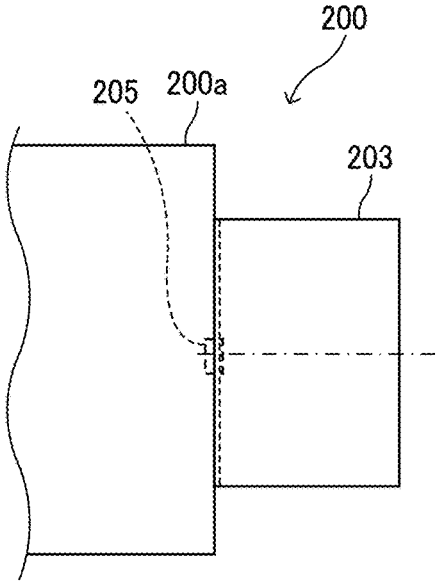
FIGS. 7A, 7B, and 7C are schematic diagrams, each illustrating a schematic configuration of the sheet feeding device according to the present embodiment, in an area including the extension sheet stacking table.
Figure 7B:
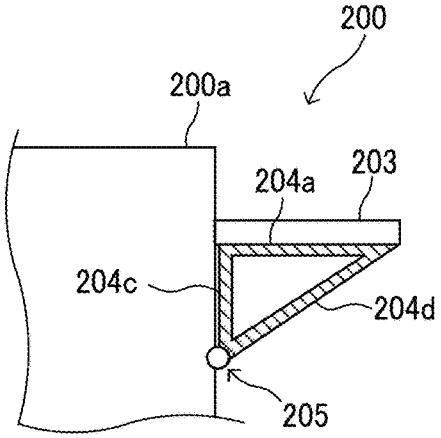
Figure 7C:
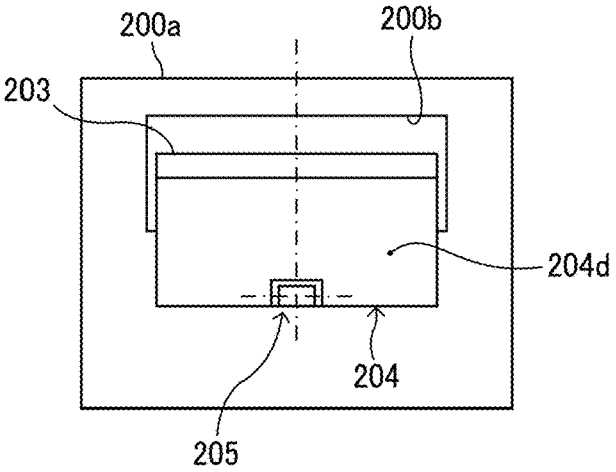

FIGS. 7A, 7B, and 7C are diagrams, each illustrating a schematic configuration of the sheet feeding device 200 according to the present embodiment, in an area including the extension sheet stacking table 203.

Specifically, FIG. 7A is a schematic plan view of the extension sheet stacking table 203, FIG. 7B is a schematic cross sectional view of the extension sheet stacking table 203, and FIG. 7C is a schematic view of the extension sheet stacking table 203, viewed from the upstream side in the sheet conveyance direction.

Figure 8:
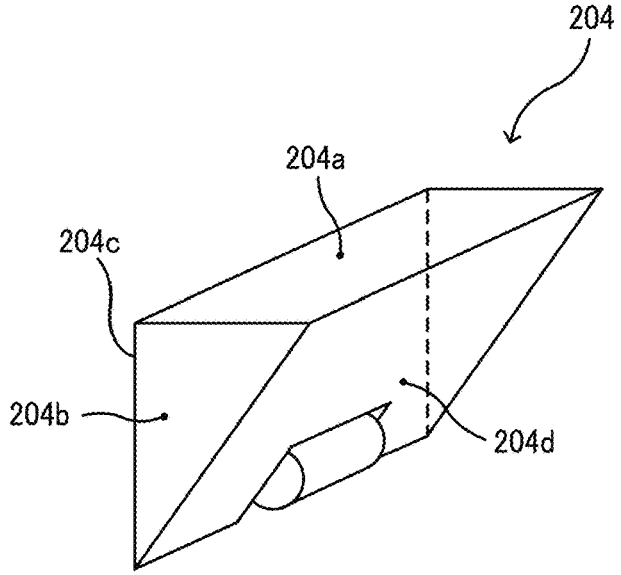
FIG. 8 is a schematic perspective view of a support.

FIG. 8 is a schematic perspective view of the support 204.

As illustrated in FIG. 8, the support 204 is a triangular prism having a right-angled triangular shape when viewed from the width direction of the sheet. A cutout is formed at the center of the lower end in the width direction of the sheet, and a sliding roller 205 that functions as a rotary member is rotatably attached to the cutout.

The support 204 having a triangular prism-shape includes an upper face 204*a*, an opposing face 204*c*, and a pair of side faces 204*b*. The upper face 204*a* is disposed facing the extension sheet stacking table 203 from below. The opposing face 204*c* is disposed facing a side wall of the housing 200*a*. The pair of side faces 204*b* has a right-angled triangular shape mounted on both sides in the width direction of the sheet. The support 204 has a sloped face 204*d* that functions as an inclined portion. The sloped face 204*d* connects the upstream end in the sheet conveyance direction of the upper face 204*a* and the lower end of the opposing face 204*c*.

The upper face 204*a* of the support 204 has the same size as the portion of the extension sheet stacking table 203 extending from the housing 200*a* and is in contact with the entire lower surface of the extension sheet stacking table 203. The opposing face 204*c* extends downward from the downstream end in the sheet conveyance direction of the upper face 204*a* and faces the side wall of the housing 200*a* at a portion below the extension sheet stacking table 203.

As illustrated in FIG. 7B, when the support 204 is viewed from the width direction of the sheet, the support 204 forms a right-angled triangular truss with the adjacent side being in contact with the lower face of the extension sheet stacking table 203 and the opposite side facing the housing 200*a*.

Figure 9:
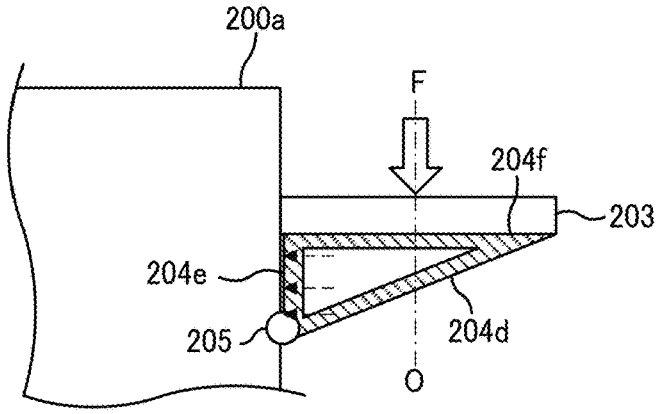
FIG. 9 is a diagram illustrating a state in which a vertically downward load is applied to the extension sheet stacking table of the sheet feeding device according to the present embodiment.

FIG. 9 is a diagram illustrating a state in which a vertically downward load F is applied to the extension sheet stacking table 203 in the sheet feeding device 200 according to the present embodiment.

In the present embodiment, the support 204 is configured to contact the side wall of the housing 200*a* below the extension sheet stacking table 203. Therefore, as illustrated in FIG. 8, when the vertically downward load F is applied to the extension sheet stacking table 203, a side face 204*e* of the support 204 comes into contact with the side wall of the housing 200*a*, so that the housing 200*a* receives the vertically downward load F via the support 204 to support the extension sheet stacking table 203.

The support 204 has a right-angled triangular truss when viewed from the width direction of the sheet. Therefore, when the support 204 receives the vertically downward load F on an upper face 204*f* of the support 204 via the extension sheet stacking table 203, most of the vertically downward load F acts as an axial force that stretches or compresses each face of the support 204. This configuration restrains deformation of the extension sheet stacking table 203 due to the vertically downward load F of the support 204 to support the extension sheet stacking table 203 reliably. Accordingly, this configuration restrains that the support 204 deforms together with the extension sheet stacking table 203 to deform the upstream end in the sheet conveyance direction of the extension sheet stacking table 203 to be lowered.

In addition, the support 204 is in contact with the extension sheet stacking table 203 to a portion upstream from the center (indicated by a broken line O in FIG. 9) in the sheet conveyance direction, so as to support the extension sheet stacking table 203 on the portion upstream from the center of the support 204 in the sheet conveyance direction. Accordingly, when a vertically downward load is applied to the extension sheet stacking table 203, the support 204 reliably restrains deformation of the upstream end in the sheet conveyance direction of the extension sheet stacking table 203.

Figure 10:
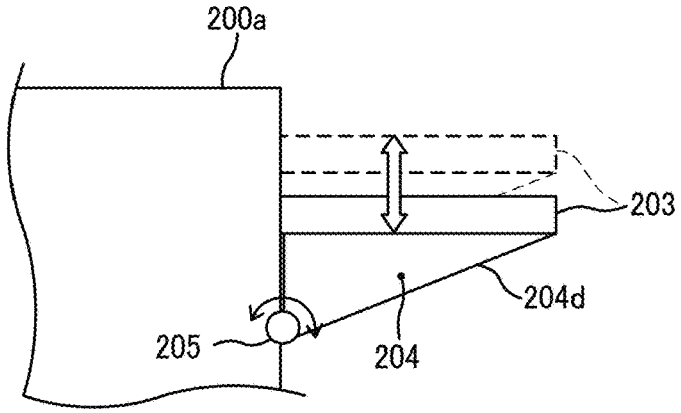
FIG. 10 is a diagram illustrating the sheet feeding device in a state of upward and downward movement of the extension sheet stacking table.

FIG. 10 is a diagram illustrating the sheet feeding device 200 in a state of upward and downward movement of the extension sheet stacking table 203.

As illustrated in FIG. 10, when the extension sheet stacking table 203 moves up and down together with the sheet stacking table 11 in the housing 200*a* of the sheet feeding device 200, the sliding roller 205 slides on the side wall surface while rotating. Accordingly, the sliding resistance between the support 204 and the housing 200*a* of the sheet feeding device 200 is reduced, and therefore the extension sheet stacking table 203 reliably moves up and down together with the sheet stacking table 11.

Note that the support 204 of the present embodiment is provided with a single set of the sliding roller 205 at the center of the support 204 in the width direction of the sheet P but may be provided with a plurality of sliding rollers 205 in the width direction of the sheet P. By providing a plurality of sliding rollers 205, the contact pressure with the housing 200*a* is reduced, and the sliding resistance between the support 204 and the housing 200*a* is further reduced. According to this configuration, the extension sheet stacking table 203 moves up and down together with the sheet stacking table 11 more reliably. Note that, when compared with the configuration in which the plurality of sliding rollers 205 is provided in the width direction of the sheet P, the number of parts is reduced with the configuration in which a single set of the sliding roller 205 is provided at the center of the support 204 in the width direction of the sheet P, resulting in a reduction in cost of the sheet feeding device 200.

Note that the support 204 may be provided on the upper portion of the extension sheet stacking table 203, so that the extension sheet stacking table 203 may be supported by the support 204 in a state in which the support 204 is in contact with the side wall of the housing 200*a* above the extension sheet stacking table 203 to lift the extension sheet stacking table 203. However, in such a configuration, when the vertically downward load is applied to the extension sheet stacking table 203, the sheet feeding device 200 preferably has the following configuration in order to support the extension sheet stacking table 203 while the support 204 is in contact with the side wall of the housing 200*a*. That is, the sheet feeding device 200 preferably has, for example, a hook-shaped portion on the side wall of the housing 200*a* and the support 204 preferably has a hook target portion that faces the hook-shaped portion from downstream in the sheet conveyance direction. As a result, the support mechanism becomes complicated.

By contrast, in a case in which the extension sheet stacking table 203 is supported by contacting the support 204 with the side wall of the housing 200*a* at a position lower than the extension sheet stacking table 203, the support 204 is brought into contact with the side wall of the housing 200*a* when the vertically downward load is applied without providing the hook-shaped portion and the hook target portion. According to this configuration, the extension sheet stacking table 203 is supported with a simple configuration.

Next, a description is given of the sheet feeding device 200 according to variations of the present embodiment.

First Variation

Figure 11:
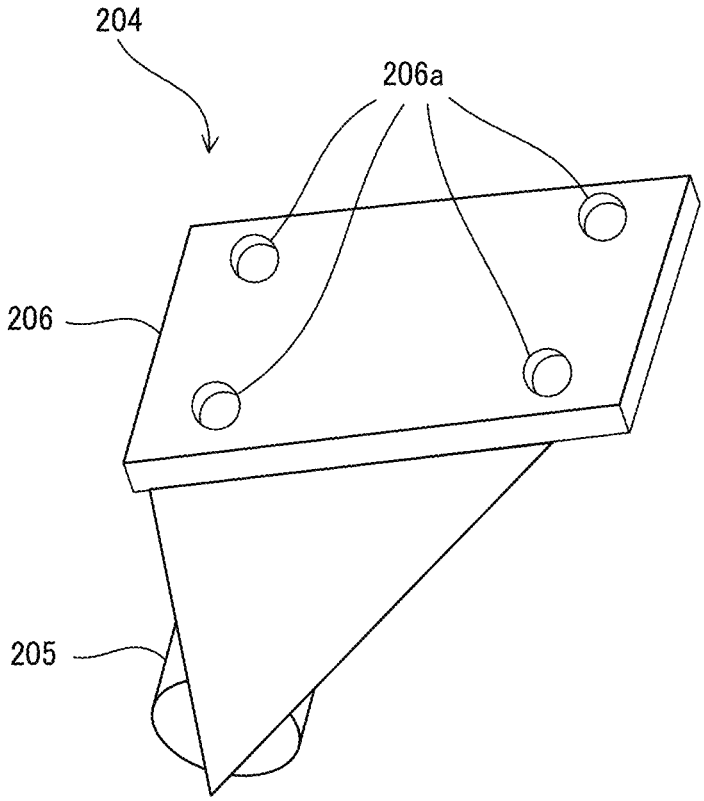
FIG. 11 is a perspective view of the support in a first variation.
Figure 12:
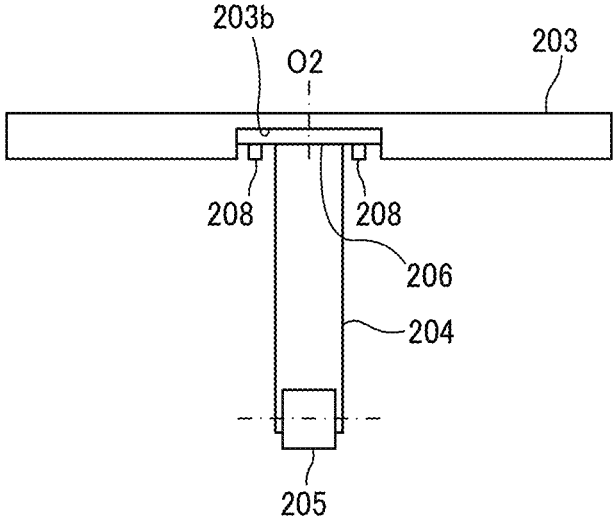
FIG. 12 is a diagram illustrating the support of the first variation in a state in which the support is attached to the extension sheet stacking table.

FIG. 11 is a perspective view of the support 204 of the first variation. FIG. 12 is a diagram illustrating the support 204 of the first variation in a state in which the support 204 is attached to the extension sheet stacking table 203.

In the first variation, the support 204 has a fastener 206 at an upper portion of the triangular prism. The fastener 206 is provided with a plurality of screw through-holes 206*a* through which screws pass.

As illustrated in FIG. 12, a recess 203*b* into which the fastener 206 is fitted is formed at a center of the extension sheet stacking table 203 in the width direction of the sheet. By fitting the fastener 206 of the support 204 into the recess 203*b*, the support 204 is positioned on the extension sheet stacking table 203. Then, the screws 208 are inserted into the screw through-holes 206*a* of the fastener 206 to be fastened to the extension sheet stacking table 203, so that the support 204 is attached to the center portion of the extension sheet stacking table 203 in the width direction of the sheet.

In the first variation, the support 204 is detachably attached to the extension sheet stacking table 203. According to this configuration, for example, when the extension sheet stacking table 203 is bent and deformed due to the weight of the bundle of sheets P stacked on the extension sheet stacking table 203, the support 204 is attached to the extension sheet stacking table 203 to support the extension sheet stacking table 203.

Further, by attaching the support 204 to the center of the extension sheet stacking table 203 in the width direction of the sheet, the extension sheet stacking table 203 is supported in the width direction of the sheet in a balanced manner.

Second Variation

Figure 13:
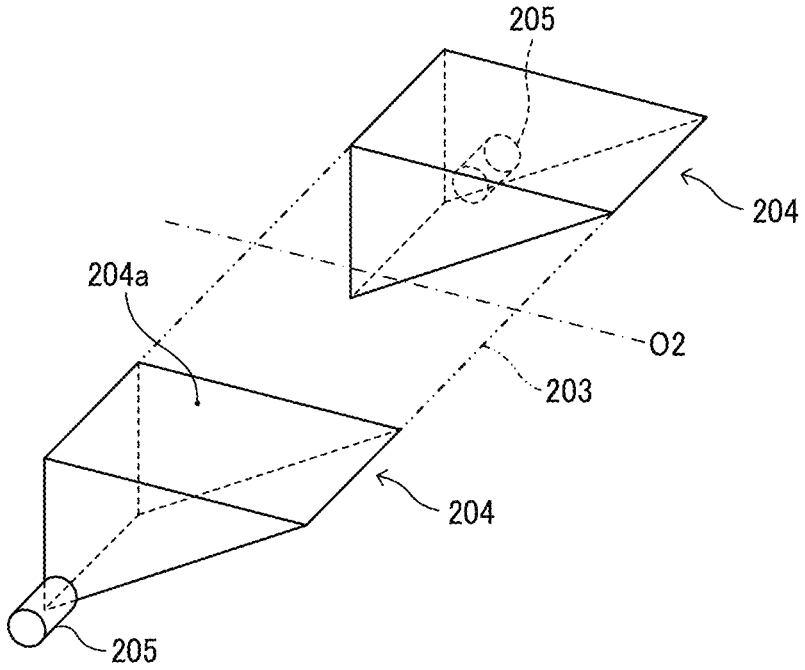
FIG. 13 is a perspective view of the support in a second variation.
Figure 14A:
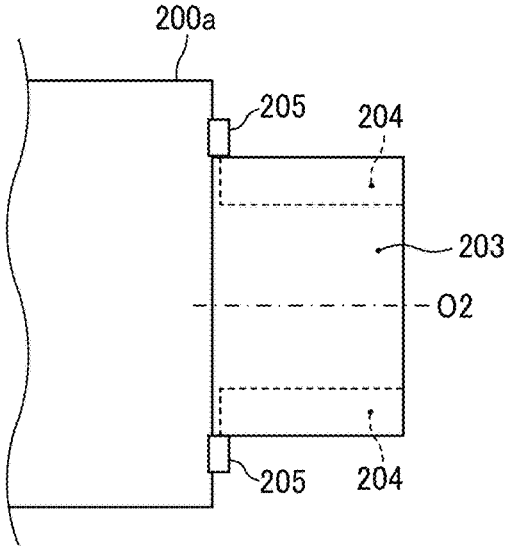
FIGS. 14A, 14B, and 14C are schematic diagrams, each illustrating a schematic configuration of the sheet feeding device of the second variation, in an area including the extension sheet stacking table.
Figure 14B:
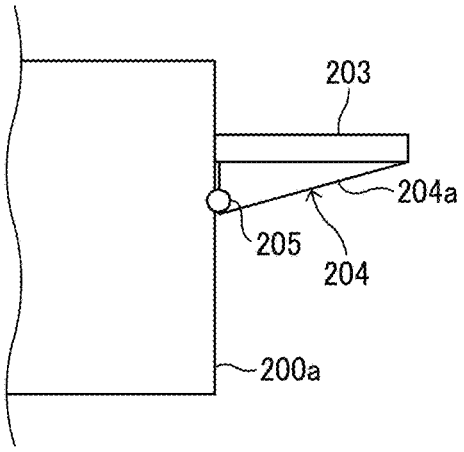
Figure 14C:
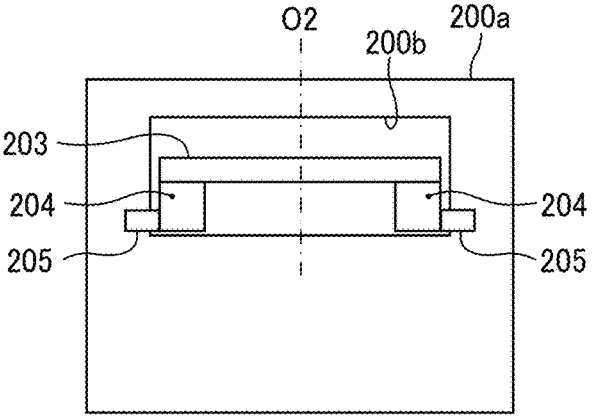

FIG. 13 is a perspective view of the support 204 of the sheet feeding device 200 in a second variation. FIGS. 14A, 14B, 14C are diagrams, each illustrating a schematic configuration of the sheet feeding device 200 of the second variation, in an area including the extension sheet stacking table 203.

Specifically, FIG. 14A is a schematic plan view of the extension sheet stacking table 203, FIG. 14B is a schematic cross-sectional view of the extension sheet stacking table 203, and FIG. 14C is a schematic view of the extension sheet stacking table 203, viewed from the upstream side in the sheet conveyance direction.

The sheet feeding device 200 of the second variation includes supports 204 in pair, which is different from the sheet feeding device 200 of the first second variation including a single set of the support 204. The supports 204 are disposed at both ends of the extension sheet stacking table 203 in the width direction of the sheet.

In a case in which the extension sheet stacking table 203 has a relatively weak rigidity, the extension sheet stacking table 203 may not be supported reliably by the single support 204 that supports simply the center of the extension sheet stacking table 203 in the width direction of the sheet, as described in the first variation of the sheet feeding device 200. In order to address this inconvenience, in a case in which the extension sheet stacking table 203 has a relatively weak rigidity, the extension sheet stacking table 203 is supported by the supports 204, as described in the second variation of the sheet feeding device 200. By so doing, deformation of the extension sheet stacking table 203 is restrained reliably.

Each of the supports 204 in the second variation is a triangular prism having a right-angled triangular shape when viewed from the width direction of the sheet and is provided with the sliding roller 205 rotatably attached to the outer face of the support 204 in the width direction of the sheet. According to this configuration, as illustrated in FIG. 14C, the sliding roller 205 is located outside from the end of the extension sheet stacking table 203 in the width direction of the sheet. As a result, the sliding roller 205 contacts the side wall of the housing 200*a* at both sides of the opening 200*b* on the side wall of the housing 200*a* in the width direction of the sheet. With this configuration, the supports 204 in the second variation contact the housing 200*a* without extending the support 204 lower than the opening 200*b*, and therefore the supports 204 support the extension sheet stacking table 203 in a manner of space saving.

In the second variation, the supports 204 are disposed at both ends of the extension sheet stacking table 203 in the width direction of the sheet. Alternatively, two or more supports may be disposed in line symmetry based on a reference line O2 extending in the width direction of the sheet and passing through the center of the extension sheet stacking table 203 in the width direction of the sheet. As described above, by disposing the two or more supports in line symmetry based on the reference line O2, the extension sheet stacking table 203 is supported in a stable manner.

Third Variation

Figure 15A:
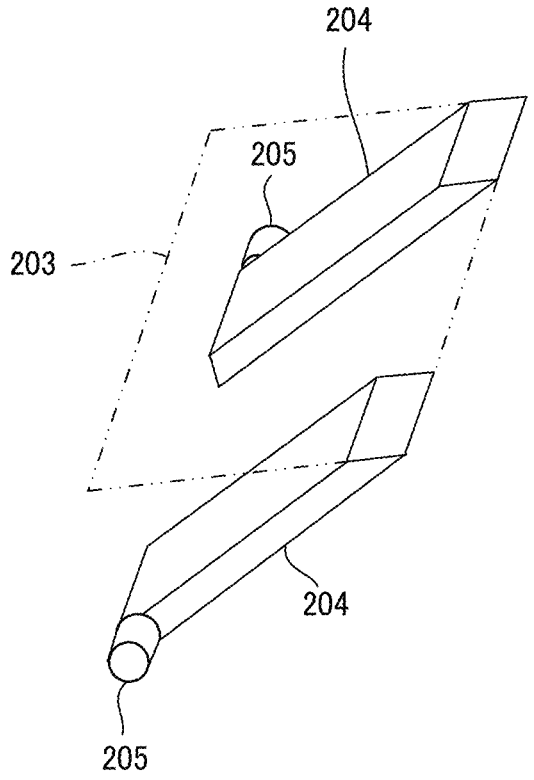
FIG. 15A is a perspective view of the support in a third variation.
Figure 15B:
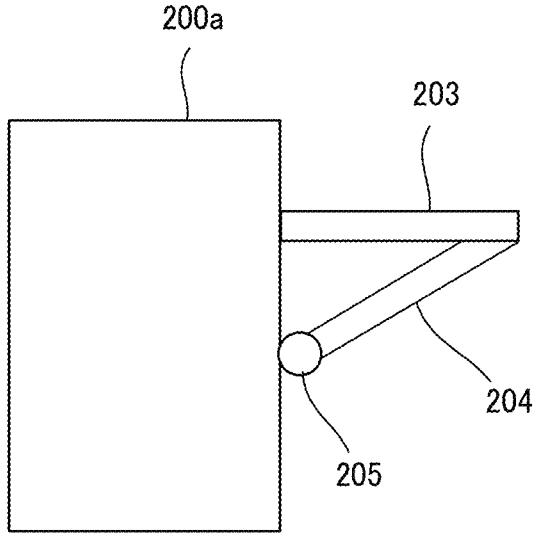
FIG. 15B is a schematic cross sectional view of the sheet feeding device of the third variation, in an area including the extension sheet stacking table.

FIG. 15A is a perspective view of the supports 204 in a third variation. FIG. 15B is a schematic cross-sectional view of an area near the extension sheet stacking table 203 of the sheet feeding device 200 of the third variation.

In the third variation, the supports 204 are planar members in pair. One end of each of the supports 204 is bonded to the extension sheet stacking table 203 at a position upstream from the center of the extension sheet stacking table 203 in the in the width direction of the sheet.

The supports 204 extend from the one end that is bonded to the extension sheet stacking table 203 to the housing 200*a* in a diagonally downward direction with respect to the sheet conveyance direction. The sliding roller 205 is disposed on the opposite end of the each of the supports 204 to contact the side wall of the housing 200*a*.

In the configuration of the third variation, when a load in the vertically downward direction is applied to the extension sheet stacking table 203, the load in the vertically downward direction, which is also referred to as the vertically downward load, acts as an axial force that compresses the support 204. This configuration restrains deformation of the extension sheet stacking table 203 due to load of the supports 204, reliably supports the extension sheet stacking table 203, and restrains the extension sheet stacking table 203 from being bent and deformed to lower the upstream side end in the sheet conveyance direction.

Note that, as in the second variation, the supports in pair in the third variation are disposed at both ends of the extension sheet stacking table 203. However, the extension sheet stacking table 203 may be supported by a single support that extends from one end to the opposite end of the extension sheet stacking table 203.

The configurations described above are examples, and aspects of the present disclosure provide respective effects as follows.

Aspect 1

A sheet feeding device (for example, the sheet feeding device 200) of Aspect 1 includes a housing (for example, the housing 200*a*), a sheet stacker (for example, the sheet stacking table 11), a stacker elevator (for example, the stacker elevation device 19), an extension sheet stacker (for example, the extension sheet stacking table 203), and a support (for example, the support 204). The sheet stacker is included in the housing and is configured to stack a sheet (for example, the sheet P). The stacker elevator is configured to elevate the sheet stacker. The extension sheet stacker is attached to the sheet stacker and is configured to extend outward from the housing. The support is configured to support the extension sheet stacker. When the support is viewed from the width direction of the sheet, the support has an inclined portion (for example, the sloped face 204*d*) configured to diagonally extend in a sheet conveyance direction to the housing from a position upstream from a center of the extension sheet stacker in the sheet conveyance direction.

In the configuration of Japanese Unexamined Patent Application Publication No. JP-2018-154458-A in which an extension sheet stacker is supported by a support such as a connection shaft straightly extending in the sheet conveyance direction, the support is regarded as a cantilever when the side face of the sheet stacker with the support being attached has a sufficient strength. Therefore, when a vertically downward load is applied to the extension sheet stacker, the bending moment alone acts on the support. As a result, the support is easily deformed due to the above-described vertically downward load.

By contrast, in Aspect 1, when the support is viewed from the width direction of the sheet, the support has the inclined portion configured to diagonally extend in the sheet conveyance direction to the housing from the position upstream from the center of the extension sheet stacker in the sheet conveyance direction. Accordingly, when the vertically downward load is applied to the extension sheet stacker, the vertically downward load acts as an axial force that compresses or stretches the inclined portion. As a result, when compared with the support disclosed in JP-2018-154458-A, the support of Aspect 1 further restrains deformation due to the vertically downward load and reliably supports the extension sheet stacker.

Aspect 2

In Aspect 1, when the support (for example, the support 204) is viewed from the width direction of the sheet (for example, the sheet P), the support forms a right-angled triangular truss having an opposite side facing the housing (for example, the housing 200*a*), an adjacent side being in contact with the extension sheet stacker (for example, the extension sheet stacking table 203), and a slanted side being the inclined portion (for example, the sloped face 204*d*) that diagonally extends in the sheet conveyance direction to the housing from the position upstream from the center of the extension sheet stacker in the sheet conveyance direction.

According to this configuration, as described in the embodiments above, the support such as the support 204 forms a right-angled triangular truss structure. When a vertically downward load is applied to the extension sheet stacker such as the extension sheet stacking table 203, most of the vertically downward load as an axial force acts to the support such as the support 204. Accordingly, this configuration restrains deformation of the support such as the support 204 when the vertically downward load is applied to the extension sheet stacker such as the extension sheet stacking table 203. As a result, the extension sheet stacker is reliably supported.

Aspect 3

According to Aspect 1 or Aspect 2, the sheet feeding device (for example, the sheet feeding device 200) further includes a rotary member (for example, the sliding roller 205) is disposed at a contact portion at which the support (for example, the support 204) contacts the housing (for example, the housing 200*a*).

According to this configuration, as described in the embodiments above, when the extension sheet stacker (for example, the extension sheet stacking table 203) moves up and down together with the sheet stacker (for example, the sheet stacking table 11), the sliding resistance between the support such as the support 204 and the housing such as the housing 200*a* is restrained. Accordingly, the extension sheet stacker is smoothly moved up and down together with the sheet stacker.

Aspect 4

According to Aspect 3, the support (for example, the support 204) includes a plurality of rotary members (for example, the plurality of sliding rollers 205) including the rotary member.

According to this configuration, as described in the embodiments above, when compared with a configuration in which a single rotary member such as the sliding roller 205 is provided, the contact pressure with the housing (for example, the housing 200*a*) is decreased. Therefore, the extension sheet stacker (for example, the extension sheet stacking table 203) reliably moves up and down together with the sheet stacker (for example, the sheet stacking table 11).

Aspect 5

According to Aspect 3 or Aspect 4, the rotary member (for example, the sliding roller 205) is located outward from each end of the extension sheet stacker (for example, the extension sheet stacking table 203) in a width direction of the sheet.

According to this configuration, as described in the second variation, the rotary member such as the sliding roller 205 contacts the housing (for example, the housing 200*a*), at a position outside of the opening (for example, the opening 200*b*) in the width direction of the sheet.

Through the opening, the extension sheet stacker such as the extension sheet stacking table 203 is extended outward from the housing. Accordingly, the length of the support (for example, the support 204) in the vertical direction, in other words, the elevation direction, is reduced to achieve the space saving.

Aspect 6

According to any one of Aspects 1 to 5, the support (for example, the support 204) is disposed at the center of the extension sheet stacker (for example, the extension sheet stacking table 203) in a width direction of the sheet.

According to this configuration, as described in the first variation, the extension sheet stacker such as the extension sheet stacking table 203 is supported in the in the width direction of the sheet in a balanced manner.

Aspect 7

According to any one of Aspects 1 to 6, the sheet feeding device 200 includes a plurality of supports (for example, the supports 204).

According to this configuration, as described in the second variation, the extension sheet stacker such as the extension sheet stacking table 203 is supported reliably.

Aspect 8

According to any one of Aspects 1 to 7, the support (for example, the support 204) is configured to be detachably attached to the extension sheet stacker (for example, the extension sheet stacking table 203).

According to this configuration, as described in the first variation, when the extension sheet stacker such as the extension sheet stacking table 203 is deformed due to the weight of the bundle of sheets stacked on the extension sheet stacker, the support (for example, the support 204) is attached to the sheet stacker to support the extension sheet stacker.

Aspect 9

According to any one of Aspects 1 to 8, an inclined portion (for example, the sloped face 204*d*) is configured to extend in a diagonally downward direction.

According to this configuration, as described in the embodiments above, when compared with a configuration in which the inclined portion is extended in a diagonally upward direction, the support (for example, the support 204) is contacted with respect to the housing (the housing 200*a*) with a simple configuration to support the extension sheet stacker (for example, the extension sheet stacking table 203).

Aspect 10

An image forming system (for example, the image forming system 1) includes an image forming apparatus (for example, the image forming apparatus 100) configured to form an image on a sheet (for example, the sheet P), and the sheet feeding device according to any one of Aspects 1 to 9 (for example, the sheet feeding device 200) configured to feed the sheet to the image forming apparatus.

According to this configuration, as described in the embodiments above, the deformation of the support (for example, the support 204) is restrained.

The above-described embodiments are illustrative and do not limit the present invention.

Thus, numerous additional modifications and variations are possible in light of the above teachings. For example, elements and/or features of different illustrative embodiments may be combined with each other and/or substituted for each other within the scope of the present invention.

This patent application is based on and claims priority to Japanese Patent Application No. 2020-172110, filed on Oct. 12, 2020, in the Japan Patent Office, the entire disclosure of which is hereby incorporated by reference herein.

REFERENCE SIGNS LIST

1: image forming system
10: sheet feed tray
11: sheet stacking table
11*a*: opening
19: stacker elevation device
100: image forming apparatus
200: sheet feeding device
200*a*: housing
200*b*: opening
201: upper panel
202: lower panel
203: extension sheet stacking table
203*a*: fitting portion
203*b*: recess
204: support
204*a*: upper face
204*b*: side face
204*c*: opposing face
204*d*: sloped face
205: sliding roller
206: fastener
206*a*: screw through-holes
208: screws
O2: reference line
P: sheet

CITATION LIST

Patent Literature

[PTL 1]
JP-2018-154458-A

The invention claimed is:

1. A sheet feeding device comprising:

a housing;

a sheet stacker included in the housing, the sheet stacker configured to stack at least one sheet;

a stacker elevator configured to elevate the sheet stacker;

an extension sheet stacker attached to the sheet stacker, the extension sheet stacker configured to extend outward from the housing;

a support configured to support the extension sheet stacker, the support having an inclined portion configured to diagonally extend in a sheet conveyance direction to the housing from a position upstream from a center of the extension sheet stacker in the sheet conveyance direction, when viewed from a width direction of the at least one sheet; and a rotary member at a contact portion of the housing at which the support contacts the housing, the rotary member in contact with a side wall surface of the housing, wherein when viewed from the width direction of the at least one sheet, the support includes a right-angled triangular truss having an opposite side facing the housing, an adjacent side being in contact with the extension sheet stacker, and a slanted side being the inclined portion that diagonally extends in the sheet conveyance direction to the housing from the position upstream from the center of the extension sheet stacker in the sheet conveyance direction.

2. The sheet feeding device according to claim 1, wherein the support includes a plurality of rotary members including the rotary member.

3. The sheet feeding device according to claim 1, wherein the rotary member is located outward from each end of the extension sheet stacker in the width direction of the at least one sheet.

4. The sheet feeding device according to claim 1, wherein the support is at a center of the extension sheet stacker in the width direction of the at least one sheet.

5. The sheet feeding device according to claim 1, further comprising:

a plurality of supports.

6. The sheet feeding device according to claim 1, wherein the support is configured to be detachably attached to the extension sheet stacker.

7. The sheet feeding device according to claim 1, wherein the inclined portion extends in a diagonally downward direction.

8. The sheet feeding device according to claim 1, wherein the rotary member is further configured to:

slide on the side wall surface of the housing while rotating along the side wall surface of the housing.

9. The sheet feeding device according to claim 1, wherein the rotary member is further configured to:

elevate and lower with the extension sheet stacker and the sheet stacker.

10. The sheet feeding device according to claim 1, wherein the rotary member is at a center of the support in the sheet conveyance direction when viewed from the width direction of the at least one sheet.

11. The sheet feeding device according to claim 1, wherein the extension sheet stacker includes a recess at the center of the extension sheet stacker; and the support contacts the extension sheet stacker in the recess.

12. The sheet feeding device according to claim 2, wherein each of the plurality of rotary members are in contact with the housing.

13. An image forming system comprising:

an image forming apparatus configured to form at least one image on at least one sheet; and a sheet feeding device, the sheet feeding device configured to feed the at least one sheet to the image forming apparatus, the sheet feeding device including, a housing;

a sheet stacker included in the housing, the sheet stacker configured to stack at least one sheet;

a stacker elevator configured to elevate the sheet stacker;

an extension sheet stacker attached to the sheet stacker, the extension sheet stacker configured to extend outward from the housing;

a support configured to support the extension sheet stacker, the support having an inclined portion configured to diagonally extend in a sheet conveyance direction to the housing from a position upstream from a center of the extension sheet stacker in the sheet conveyance direction, when viewed from a width direction of the at least one sheet; and a rotary member at a contact portion of the housing at which the support contacts the housing, the rotary member in contact with a side wall surface of the housing, wherein the rotary member is at a center of the support in the sheet conveyance direction when viewed from the width direction of the at least one sheet.

14. The image forming system according to claim 13, wherein when viewed from the width direction of the at least one sheet, the support includes a right-angled triangular truss having an opposite side facing the housing, an adjacent side being in contact with the extension sheet stacker, and a slanted side being the inclined portion that diagonally extends in the sheet conveyance direction to the housing from the position upstream from the center of the extension sheet stacker in the sheet conveyance direction.

15. The image forming system according to claim 13, wherein the rotary member is further configured to:

slide on the side wall surface of the housing while rotating along the side wall surface of the housing.

16. The image forming system according to claim 13, wherein the rotary member is further configured to:

elevate and lower with the extension sheet stacker and the sheet stacker.

17. The image forming system according to claim 13, wherein the extension sheet stacker includes a recess at the center of the extension sheet stacker; and the support contacts the extension sheet stacker in the recess.

18. The image forming system according to claim 13, wherein the support includes a plurality of rotary members including the rotary member; and each of the plurality of rotary members are in contact with the housing.

19. A sheet feeding device comprising:

a housing;

a sheet stacker included in the housing, the sheet stacker configured to stack at least one sheet;

a stacker elevator configured to elevate the sheet stacker;

an extension sheet stacker attached to the sheet stacker, the extension sheet stacker configured to extend outward from the housing;

a support configured to support the extension sheet stacker, the support having an inclined portion configured to diagonally extend in a sheet conveyance direction to the housing from a position upstream from a center of the extension sheet stacker in the sheet conveyance direction, when viewed from a width direction of the at least one sheet; and a rotary member at a contact portion of the housing at which the support contacts the housing, the rotary member in contact with a side wall surface of the housing, wherein the rotary member is at a center of the support in the sheet conveyance direction when viewed from the width direction of the at least one sheet.

* * * * *